US005229263A

United States Patent [19]

Yoshida et al.

[11] Patent Number: 5,229,263

[45] Date of Patent: Jul. 20, 1993

[54] SILVER HALIDE PHOTOGRAPHIC MATERIAL AND PROCESS FOR THE DEVELOPMENT THEREOF

[75] Inventors: Tetsuo Yoshida; Koichi Kuno, both of Kanagawa, Japan

[73] Assignee: Fuji Photo Film Co., Ltd., Kanagawa, Japan

[21] Appl. No.: 699,837

[22] Filed: May 14, 1991

[30] Foreign Application Priority Data

May 15, 1990 [JP] Japan ..... 2-124726
Sep. 14, 1990 [JP] Japan ..... 2-245814

[51] Int. Cl.[5] ..... G03C 1/08

[52] U.S. Cl. ..... 430/600; 430/567; 430/569; 430/604; 430/607

[58] Field of Search ..... 430/600, 604, 607, 567, 430/569

[56] References Cited

U.S. PATENT DOCUMENTS

| | | | |
|---|---|---|---|
| 3,047,393 | 7/1962 | Herz et al. . | |
| 3,890,154 | 6/1975 | Ohkubo et al. . | |
| 4,945,035 | 7/1990 | Keevert, Jr. et al. | 430/567 |
| 5,015,567 | 5/1991 | Suga et al. | 430/569 |
| 5,057,402 | 10/1991 | Shiba et al. | 430/377 |

FOREIGN PATENT DOCUMENTS 0336425 10/1989 European Pat. Off. .

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

A silver halide photographic material comprising a support having thereon at least one light-sensitive silver halide emulsion layer containing silver halide grains, wherein said silver halide grains have a silver chloride content of 30 mol% or more and contain (i) and iridium compound in an amount of $10^{-6}$ mol or less per mol of silver halide, (ii) at least one compound selected from the group consisting of iron, rhenium, ruthenium and osmium compounds in an amount of $10^{-3}$ mol or less per mol of silver halide, and (iii) (a) at least one compound selected from the group consisting of compounds represented by general formula (1-a), (1-b) and (1-c):

(1-a)

(1-b)

(1-c)

wherein Z represents a $C_{1-18}$ alkyl group, a $C_{6-18}$ aryl group or a heterocyclic group; Y represents an atomic group required for the formation of a $C_{6-18}$ aromatic ring or a heterocyclic group, said groups represented by Z or formed by Y may be substituted with at least one substituent; M represents a metallic atom or organic cation; and n represents an integer from 2 to 10, and/or (b) the silver halide grains have been chemically sensitized at a pH of 5.5 or less. A process for the development of the silver halide photographic material is also provided wherein processing is effected by an automatic developing machine in a total processing time of 20 to 60 seconds.

17 Claims, No Drawings

SILVER HALIDE PHOTOGRAPHIC MATERIAL AND PROCESS FOR THE DEVELOPMENT THEREOF

FIELD OF THE INVENTION

The present invention relates to a silver halide photographic material. More particularly, the present invention relates to a silver halide photographic material which exhibits high sensitivity and excellent, rapid processability in a high intensity short time exposure, and to a process for the development thereof.

BACKGROUND OF THE INVENTION

In recent years, scanner systems have widely been employed in the field of printing plate making. There are various recording apparatus which make practical use of image formation processes by these scanner systems. Glow lamps, xenon lamps, tungsten lamps, LEDs, He-He lasers, argon lasers, and semiconductor lasers, for instance have been used as recording light sources for these scanner system recording apparatus.

The light-sensitive materials to be applied to these scanners are required to exhibit various properties. In particular, since a scanner system recording needs an exposure for a short period of time, such as $10^{-3}$ to $10^{-7}$ second, the light-sensitive materials are required to exhibit a high sensitivity and a high contrast under such conditions. Specifically, in the field of facsimile telecommunication, these light-sensitive materials need to exhibit a high rapid developability in order to meet the required rapid reception of data. In the future, it will be desired to expedite scanning, increase the number of scanning lines and further converge light beams to provide a higher picture quality. A light-sensitive material which exhibits a high sensitivity and a high contrast has therefore been desired.

The term "rapid developability" as used herein means the capability of being processed in 20 to 60 seconds between the time at which the leading edge of the film is introduced into the automatic developing machine and the time at which the leading edge of the film comes out of the automatic developing machine via a developing bath, a connecting section, a fixing bath, a connecting section, a washing bath and a drying section. When the conveying speed in the automatic developing machine is raised to reduce the time required for these processing steps, various troubles may arise such as (1) a reduction in contrast, (2) unthorough fixing, (3) unthorough rinse, and (4) unthorough drying.

In general, it is advantageous to raise the silver chloride content of the silver halide emulsion to solve troubles (1) and (2). However, this approach is disadvantageous in that is causes a reduction in the sensitivity of the light-sensitive material. In order to solve troubles (2), (3) and (4), it is effective to reduce the coated amount of silver and the gelatin content in the silver halide light-sensitive material. However, it is necessary to reduce the size of the grains contained in the silver halide emulsion in order to make up for the resulting reduction in the blackened density and the deterioration in the graininess. In this regard, too, there is a need for a light-sensitive material which comprises a silver halide emulsion with a high silver chloride content, but still exhibits a high sensitivity. The inventors found that these objects can be effectively accomplished by incorporating iridium compounds, iron compounds, rhenium compounds, ruthenium compounds and osmium compounds in silver halide grains. However, this approach is disadvantageous in that although it provides a high sensitivity, it easily causes fogging and also easily gives a low sensitivity and contrast when the development time is short.

SUMMARY OF THE INVENTION

It is therefore an object of the present invention to provide a light-sensitive material which exhibits a high sensitivity upon a high intensity exposure.

It is another object of the present invention to provide a processing process which is suitable for rapid development.

These and other objects of the present invention are accomplished with (I) a silver halide photographic material comprising a support having thereon at least one light-sensitive silver halide emulsion layer containing silver halide grains, wherein said silver halide grains have a silver chloride content of 30 mol% or more and contain (i) an iridium compound in an amount of $10^{-6}$ mol or less per mol of silver halide, (ii) at least one compound selected from the group consisting of iron, rhenium, ruthenium and osmium compounds in an amount of $10^{-3}$ mol or less per mol of silver halide, and (iii) at least one compound selected from the group consisting of compounds represented by general formula (1-a), (1-b) or (1-c):

$$Z-SO_2.S-M \quad \text{(1-a)}$$

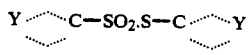

(1-b)

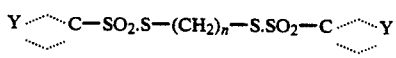

(1-c)

wherein Z represents a $C_{1-18}$ alkyl group, a $C_{6-18}$ (including Carbon number in a substituent(s); the same hereinafter) aryl group or a heterocyclic group; Y represents an atomic group required for the formation of a $C_{6-18}$ aromatic ring or a heterocyclic group, said groups represented by Z or formed by Y may be substituted with at least one substituent; M represents a metallic atom or organic cation; and n represents an integer from 2 to 10: or (II) a silver halide photographic material comprising a support having thereon at least one light-sensitive silver halide emulsion layer containing silver halide grains, wherein said silver halide grains have a silver chloride content of 30 mol% or more, contain an iridium compound in an amount of $10^{-6}$ mol or less per mol of silver halide, and at least one compound selected from the group consisting of iron, rhenium, ruthenium and osmium compounds in an amount of $10^{-3}$ mol or less per mol of silver halide, and have been chemically sensitized at a pH of 5.5 or less.

DETAILED DESCRIPTION OF THE INVENTION

The present invention will be described in greater detail below.

The silver halide photographic emulsion according to the present invention comprises silver chloride, silver bromochloride or silver bromochloroiodide. The silver chloride content is preferably in the range of 30 mol% or more, more preferably 60 mol% or more. The silver iodide content is preferably in the range of 5 mol% or less, more preferably 2 mol% or less.

The silver halide grains in the photographic emulsion may be in a cubic form, a tetradecahedral form, an octahedral form, an amorphous form or a tabular form, preferably a cubic or tabular form. The average diameter of silver halide grains is preferably in the range of 0.01 to 1 μm, more preferably 0.4 μm or less. The grain size distribution is preferably narrow, having fluctuation coefficient of 15% or less, preferably 10% or less as represented by {(standard deviation of grain diameters)/(average grain diameter)}×100, and in vicinity to zero as close as possible is more preferred.

The silver halide grains for the present invention may be uniform or different in phase between their inside and their surface layer.

The photographic emulsion for the present invention can be prepared according to the process described in P. Glafkides, *Chimie et Physique Photographique,* Paul Montel (1967), G. F. Duffin, *Photographic Emulsion Chemistry,* Focal Press (1966), and V. L. Zelikman et al., *Making and Coating Photographic Emulsion,* Focal Press (1964).

The emulsion can be prepared by the acid process, the neutral process, the ammonia process, etc. The reaction of soluble silver salts and soluble halides can be carried out by a single jet process, a double jet process, a combination thereof, or the like.

A method in which grains are formed in the presence of an excess of silver ions (so-called reverse mixing method) may be used. Further, a so-called controlled double jet process, in which the pAg value of a liquid phase in which silver halide grains are formed, is maintained constant, may also be used.

According to the controlled double jet process, a silver halide emulsion having a regular crystal form and an almost uniform grain size can be obtained.

In order to provide a uniform grain size, the rate at which silver nitrate or a halogenated alkali is added may preferably be altered depending on the growth rate of grains as described in British Patent 1,535,016, and JP-B-48-36890 and JP-B-52-16364 (the term "JP-B" as used herein means an "examined Japanese patent publication"), or the concentration of the aqueous solution may preferably be altered as described in British Patent 4,242,445, and JP-A-55-158124 (the term "JP-A" as used herein means an "unexamined published Japanese patent application") to allow rapid growth of the grains within a range not greater than the degree of critical saturation.

The grain formation of the silver halide emulsion of the present invention may be preferably effected in the presence of a silver halide solvent such as a 4-substituted thiourea or an organic thioether compound.

Preferred 4-substituted thiourea silver halide solvents are compounds represented by the following general formula (2) described in JP-A-53-82408 and JP-A-55-77737:

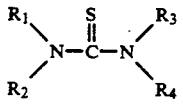

(2)

wherein $R_1$, $R_2$, $R_3$ and $R_4$ may be the same or different and each represents a substituted or unsubstituted alkyl group, a substituted or unsubstituted alkenyl group (such as an allyl group) or a substituted or unsubstituted aryl group. The total number of carbon atoms contained in $R_1$ to $R_4$ is preferably in the range of 30 or less. $R_1$ and $R_2$, $R_2$ and $R_3$, or $R_3$ and $R_4$ may be connected to each other to form a 5- or 6-membered heterocyclic ring containing a nitrogen atom or further containing at least one of hetero atoms such as nitrogen, oxygen and sulfur atoms (e.g., imidazolidinethione, piperidine or morpholine). The heterocyclic ring may be condensed with a benzene ring. The above mentioned alkyl group may be either straight-chain or branched. The aryl group is preferably a phenyl or a naphthyl group.

Examples of substituents to the alkyl group represented by $R_1$, $R_2$, $R_3$ or $R_4$ include a hydroxyl group (—OH), a carboxyl group, a sulfonic acid group, an amino group, an alkoxy group containing a $C_{1-5}$ alkyl residue (O-alkyl), a phenyl group, and a 5- or 6-membered heterocyclic group (e.g, furan). The heterocyclic group preferably has at least one of nitrogen, oxygen and sulfur atoms as a hetero atom and the heterocyclic ring may be condensed with a benzene ring (the same definition can be provided for a heterocyclic group disclosed hereinafter). Examples of substituents to the aryl group represented by $R_1$, $R_2$, $R_3$ or $R_4$ include a hydroxyl group, a carboxyl group and a sulfonic acid group.

In particular, three or more of $R_1$ to $R_4$ are preferably $C_{1-5}$ alkyl groups. The aryl group represented by $R_1$, $R_2$, $R_3$ or $R_4$ is preferably a phenyl group. The total number of carbon atoms contained in $R_1$ to $R_4$ is more preferably in the range of 20 or less.

Specific examples of compounds which can be used in the present invention are set forth below.

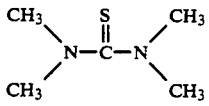

(2)-1

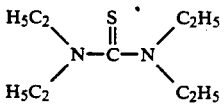

(2)-2

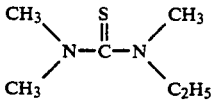

(2)-3

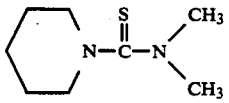

(2)-4

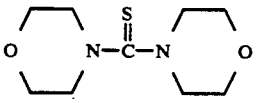

(2)-5

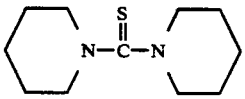

(2)-6

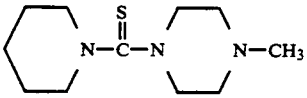

(2)-7

-continued (2)-8

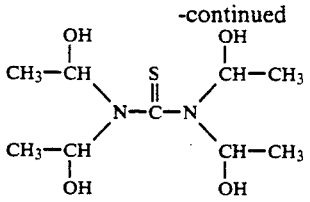

(2)-9

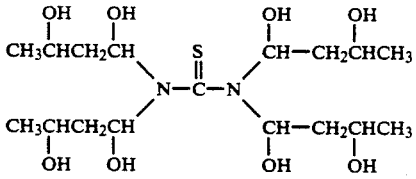

(2)-10

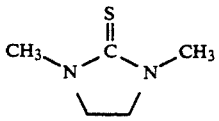

(2)-11

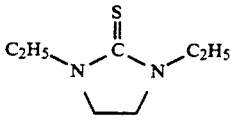

(2)-12

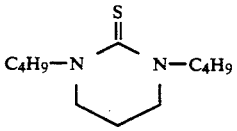

(2)-13

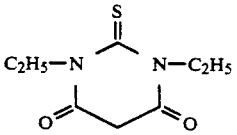

(2)-14

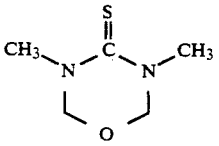

(2)-15

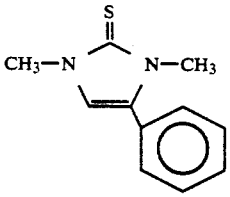

(2)-16

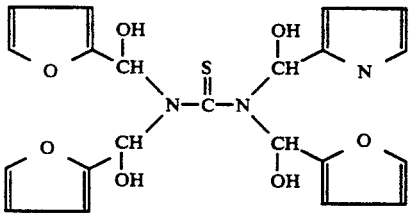

Examples of organic thioether silver halide solvents which are preferable in the present invention include compounds containing at least one group comprising oxygen atom and sulfur atom which are separated by ethylene (e.g., —O—$CH_2CH_2$—S—) as disclosed in JP-B-47-11386 (U.S. Pat. No. 3,574,628), and chain thioether compounds containing alkyl groups (each containing at least two substituents selected from hydroxyl, amino, carboxyl, amide and sulfone) at the both ends thereof as disclosed in JP-A-54-155828 (U.S. Pat. No. 4,276,374). Specific examples of such compounds are set forth below:

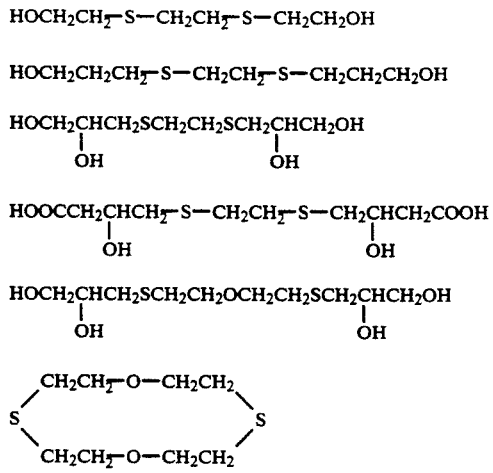

The amount of the silver halide solvent to be incorporated depends on the type of compound to be used and the desired grain size and halogen composition, etc. The amount is preferably in the range of $10^{-5}$ to $10^{-2}$ mol per mol of silver halide.

If such a silver halide solvent causes the grains to grow to a size exceeding the desired value, the temperature at which the grains are formed, the time during which a silver salt solution and a halogen salt solution are added, etc., may be altered to obtain the desired grain size.

The iridium compounds in the photographic material of the present invention increase the sensitivity and the gradiante upon a high intensity exposure.

The iridium compounds for the present invention may be water-soluble iridium compounds. Examples of such water-soluble iridium compounds include halogenated iridium (III) compounds, halogenated iridium (IV) compounds, and iridium complex salts containing as ligands halogen, amines, oxalate, etc. Such salts include hexachloroiridium (III) and (IV) complex salts, hexamineiridium (III) and (IV) complex salts, and trioxalateiridium (III) and (IV) complex salts. In the present invention, any combination of trivalent and tetravalent compounds among these compounds may be used. These iridium compounds may be used in the form of a solution in water or any other suitable solvent. In order to stabilize the iridium compound solution, any commonly used method can be employed. In particular, an aqueous solution of halogenated hydrogen (e.g., hydrochloric acid, bromic acid, fluoric acid) or halogenated alkali (e.g., KCl, NaCl, KBr, NaBr) can be added to the system. Instead of using a water-soluble iridium compound, other silver halide grains doped with iridium may be used during the preparation of the silver halide grains so that the iridium compound is dissolved in the system.

The total amount of the iridium compounds to be added is preferably in the range of $1\times10^{-8}$ to $1\times10^{-6}$ mol, more preferably $5\times10^{-8}$ to $5\times10^{-7}$ mol, per mol of silver halide finally formed. When the amount exceeds $1\times10^{-6}$ mol per mol of silver halide the sensitivity tends to decrease.

The incorporation of these compounds can be properly effected at any stage during the preparation of silver halide emulsion and before the coating of the silver halide emulsion, particularly during the formation of grains, so that these compounds are incorporated in the silver halide grains.

Preferred examples of iridium compounds include halogenamines and oxalate complex salts such as iridous chloride (III), iridous bromide (III), iridic chloride (IV), sodium hexachloroiridate (III), hexachloroiridium (III) salt, hexamineiridium (IV) salt, trioxalatoiridium (III) salt and trioxalatoiridium (IV).

In the photographic material of the present invention the ion, rhenium, ruthenium and osmium compounds increase the sensitivity of the photographic material.

The iron compounds for the present invention can be divalent or trivalent iron ion-containing compounds, preferably iron salts or iron complex salts soluble in the concentration range used in the present invention. Examples of such divalent or trivalent iron ion-containing compounds include ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ferrous ammonium nitrate, basic ferric acetate, ferric albuminate, ferric ammonium acetate, ferric bromide, ferric chloride, ferric chlorate, ferric citrate, ferric fluoride, ferric formate, ferric glycerophosphate, ferric hydroxide, acidic ferric phosphate, ferric nitrate, ferric phosphate, ferric pyrrolinate, ferric sodium pyrrolinate, ferric thiocyanate, ferric sulfate, ferric ammonium sulfate, ferric guanidine sulfate, ferric ammonium citrate, potassium hexacyanoferrate (II), ferric potassium pentacyanoammine, ferric sodium ethylenedinitrilo-tetraacetate, potassium hexacyanoferrate (III), tris(dipyridyl) ferric chloride, ferric potassium pentacyanonitrosil, and hexarare ferric chloride.

Among these compounds, hexacyanoferrates (II), hexacyanoferrates (III), ferrous thiocyanates, and ferric thiocyanates exhibit remarkable effects.

The rhenium, ruthenium and osmium compounds for the present invention are preferably in the form of a hexadentate complex as described in European Patent Disclosure (EP) 0336689A, 0336427A1, 0336425A1, and 0336426A1, particularly containing at least 4 cyanide ligands. In a preferred embodiment, these compounds can be represented by the following general formula:

$$[M(CN)_{6-y}L_y]^n$$

wherein M represents rhenium, ruthenium or osmium; L represents a bridging ligand; y represents an integer 0, 1 or 2; and n represents -2, -3 or -4.

Examples of such a compound include $[Re(CN)_6]^{-4}$, $[Ru(CN)_6]^{-4}$, $[Os(CN)_6]^{-4}$, $[ReF(CN)_5]^{-4}$, $[RuF(CN)_5]^{-4}$, $[OsF(CN)_5]^{-4}$, $[ReCl(CN)_5]^{-4}$, $[RuCl(CN)_5]^{-4}$, $[OsCl(CN)_5]^{-4}$, $[ReBr(CN)_5]^{-4}$, $[RuBr(CN)_5]^{-4}$, $[OsBr(CN)_5]^{-4}$, $[ReI(CN)_5]^{-4}$, $[RuI(CN)_5]^{-4}$, $[OsI(CN)_5]^{-4}$, $[ReF_2(CN)_4]^{-4}$, $[RuF_2(CN)_4]^{-4}$, $[OsF_2(CN)_4]^{-4}$, $[ReCl_2(CN)_4]^{-4}$, $[RuCl_2(CN)_4]^{-4}$, $[OsCl_2(CN)_4]^{-4}$, $[RuBr_2(CN)_4]^{-4}$, $[OsBr_2(CN)_4]^{-4}$, $[ReBr_2(CN)_4]^{-4}$, $[RuI_2(CN)_4]^{-4}$, $[OsI_2(CN)_4]^{-4}$, $[Ru(CN)_5(OCN)]^{-4}$, $[Os(CN)_5(OCN)]^{-4}$, $[Ru(CN)_5(SCN)]^{-4}$, $[Os(CN)_5(SCN)]^{-4}$, $[Ru(CN)_5(NH_3)]^{-4}$, $[Os(CN)_4(NH_3)]^{-4}$, $[Ru(CN)_5(H_2O)]^{-3}$, and $[Os(CN)_5(H_2O)]^{-3}$.

The rhenium, ruthenium and osmium compounds are preferably incorporated to silver halide grains during formation of the grains. The compounds may be uniformly dispersed in the grains, or may be localized in the grains at the former stage, at the intermediate stage or at the latter stage of the grain formation. It is preferred that the compounds is added to the grains at the latter stage of the grain formation, that is, after attaining of formation of 50%, more preferably after 80% of the particle diameter of the end product.

The amount of the compounds added to the grains is $10^{-3}$ mol or less, preferably $10^{-6}$ to $10^{-4}$ mol per mol of silver.

In the present invention other compounds of metals of the VIII group (in the Periodic Table) other than the above-described metals, that is, cobalt, nickel, rhodium, palladium and platinum can also be used in combination with the above-described metals. Especially, a combination with a rhodate such as rhodium chloride and ammonium hexachlororhodate (III) is preferred because an emulsion which can provide a high contrast can be obtained.

The silver halide emulsion of present invention is normally subjected to chemical sensitization. This chemical sensitization process may be any of the known processes such as a sulfur sensitization process, a selenium sensitization process, a reduction sensitization process and a noble metal sensitization process, either singly or in combination. In particular, when the chemical sensitization is conducted at a PH of 5.5 or less, the combination of a gold sensitization process and a sulfur sensitization process and the combination of a gold sensitization process and a selenium sensitization process are preferable.

A typical noble metal sensitization process is the gold sensitization process. The gold sensitization process uses a gold compound, mainly gold complex. The gold complex may contain complexes of noble metals other than gold, such as platinum and palladium.

The sulfur sensitizers can be sulfur compounds contained in gelatin as well as various sulfur compounds such as thiosulfates, thioureas, thiazoles and rhodanines.

The reduction sensitizers can be stannous salts, amines, formamidinesulfonic acid, silane compounds, etc.

The selenium sensitizers can be active and inactive selenium compounds.

The optimum amount of such a chemical sensitizer to be added is selected based on the size and shape of silver halide grains or the atmosphere in which the chemical sensitization is to be effected.

Chemical sensitization starts when a chemical sensitizer is added to the system and is completed by any suitable method. Examples of such a method include one in which comprises lowering the temperature, one in which comprises lowering the pAg value, one in which comprises lowering the pH value, and one in which comprises the addition of a stabilizer.

In the embodiment (II) of the present invention the requirement that the pH to be 5.5 or less (preferably 5.2 or less, and preferably not less than 4.5) is preferably met during at least one fifth, more preferably at least half, and most preferably during the entire period of the sensitization time. These conditions are preferably satisfied during the former half period of the sensitization time, particularly from the start of the sensitization. By adjusting the pH as described above remarkable effects in improving photographic characteristics (especially in increase of sensitivity) can be obtained.

The pH adjustors can be ordinary acids or bases such as sulfuric acid, phosphoric acid, acetic acid, sodium hydroxide and sodium carbonate.

The chemical sensitization may be effected at any step between the formation and the coating of the grains, preferably after desalting. The chemical sensitization is normally effected at a temperature of 50° to 75° C. for 10 to 100 minutes.

In the photographic material of the present invention the compounds represented by general formula (1-a), (1-b) or (1-c) inhibit formation of fog and increase the gradation.

In the general formulae (1-a), (1-b) and (1-c) of the present invention the alkyl, aryl, and heterocyclic ring groups and aromatic and heterocyclic rings represented by Z and Y may be substituted.

Examples of the substituents in these substituted alkyl, aryl, heterocyclic and aromatic groups, include lower alkyl groups (preferably $C_{1-4}$ alkyl group) such as methyl and ethyl, aryl groups such as phenyl, $C_{1-8}$ alkoxyl groups, halogen atoms such as chlorine, nitro group, amino groups, amido groups and a carboxyl group.

The aryl group and the aromatic ring are preferably a phenyl group or a naphthyl group.

Examples of the heterocyclic rings represented by Z or heterocyclic rings formed by Y include thiazole, benzthiazole, imidazole, benzimidazole, tetrazole, and oxazole rings.

The metallic atom represented by M is preferably an alkali metal atom such as sodium ion and potassium ion. The organic cation is preferably ammonium ion, guanidine group, or the like.

Examples of compounds represented by the formula (1-a), (1-b) or (1-c) are set forth below.

(1)

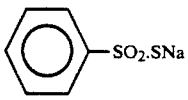

(2)

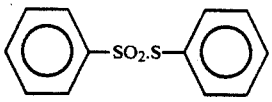

(3)

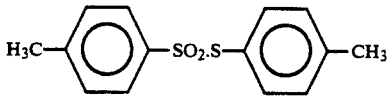

(4)

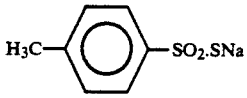

$CH_3.SO_2.SNa$ (5)

(6)

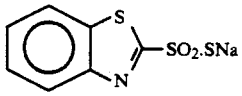

-continued (7)

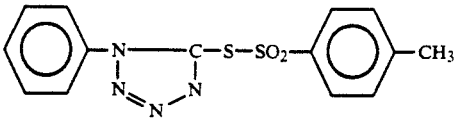

(8)

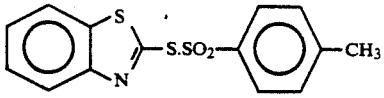

(9)

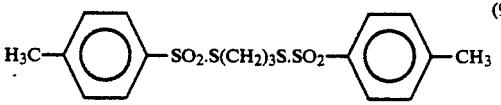

(10)

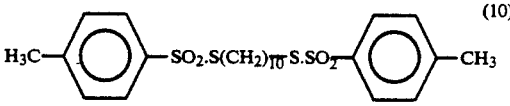

$CH_3—SO_2.SNa$ (12)

$C_{12}H_{25}—SO_2.SNa$ (13)

(14)

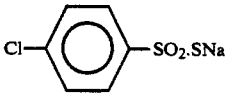

(15)

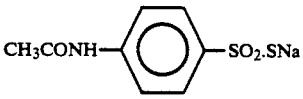

(16)

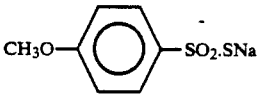

(17)

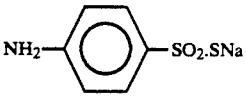

The synthesis of compounds represented by the general formulae (1-a), (1-b) and (1-c) can be normally accomplished by any of the known methods.

For example, the corresponding sulfonyl chloride and sodium sulfate can be reacted with each other, or the corresponding sodium sulfinate and sulfur can be reacted with each other, to accomplish this synthesis. On the other hand, these compounds can be easily obtained as commercial products.

The amount of the compound represented by the general formula (1-a), (1-b) or (1-c) to be incorporated into the silver halide grains is preferably in the range of 0.001 to 1 g, particularly 0.01 to 0.2 g per, mol of silver halide. The time at which the compound is added may be during the formation of silver halide grains or immediately before coating, preferably during the formation of silver halide grains or chemical sensitization.

The light-sensitive silver halide emulsion of the present invention may be spectrally sensitized with a sensitizing dye to a relatively long wavelength such as blue light, green light, red light or infrared light. Examples of this sensitizing dye include a cyanine dye, a melocyanine dye, a complex cyanine dye, a complex melocyanine dye, a holopolar cyanine dye, a stryl dye, a hemicyanine dye, an oxonol dye, and a hemioxonol dye.

Examples of useful sensitizing dyes which can be used in the present invention are described in Research Disclosure Item 17643 IV-A (December 1978, p. 23), Item 1831X (August 1979, p. 437), and the literature references cited therein.

In particular, sensitizing dyes which exhibit a spectral sensitivity suitable for the spectral characteristics of various scanner light sources can be advantageously selected.

For example, (A) simple melocyanines described in JP-A-60-162247 and JP-A-2-48653, U.S. Patent 2,161,331, and West German Patent 936,071 can be advantageously selected for argon laser light sources, (B) trinucleus cyan dyes described in JP-A-50-62425, JP-A-54-18726, and JP-A-59-102229 can be advantageously selected for helium-neon laser light sources; (C) thiacarbocyanines described in JP-B-48-42172, 51-9609, and 55-39818, and JP-A-62-284343 can be advantageously selected for LED light sources; and (D) tricarbocyanines as described in JP-A-59-191032 and JP-A-60-80841 and dicarbocyanines containing 4-quinoline nucleus as described in JP-A-59-192242 can be advantageously selected for semiconductor laser light sources.

Typical examples of the compounds to be used as sensitizing dyes will be set forth below.

Examples of compound (A) include:

A-1

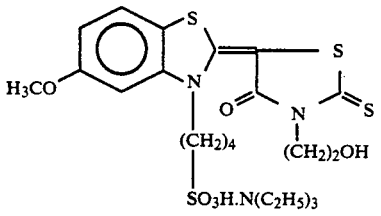

A-2

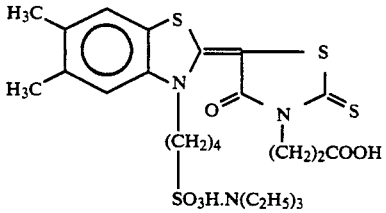

A-3

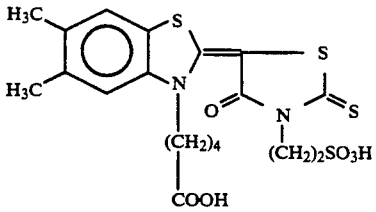

A-4

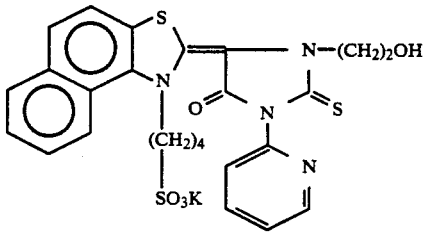

-continued

A-5

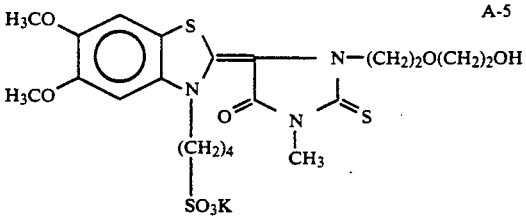

Examples of compound (B) include:

B-1

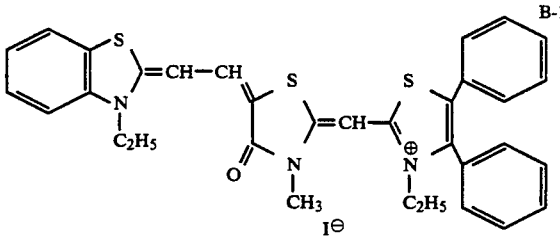

B-2

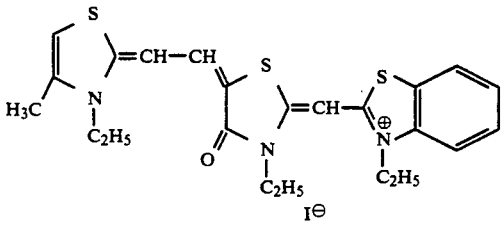

B-3

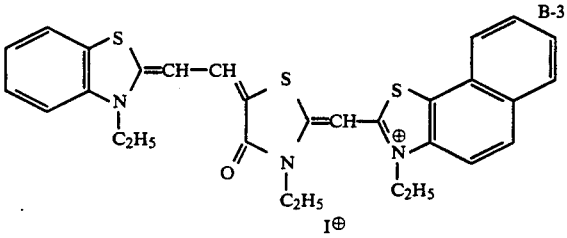

B-4

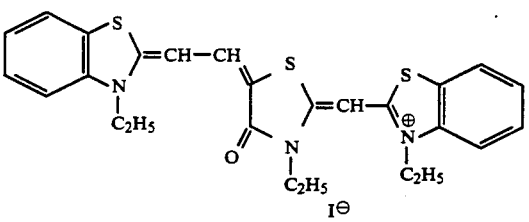

Examples of compound (C) include those represented by:

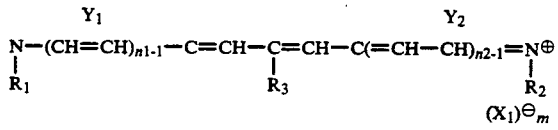

wherein $Y_1$ and $Y_2$ each represents a nonmetallic atomic group required to form a benzothiazole ring, a benzoselenazole ring, a naphthothiazole ring, a naphthoselenazole ring or a quinoline ring, which may be substituted by a lower alkyl group, alkoxy group, hydroxyl group, aryl group, alkoxycarbonyl group or a halogen atom; $R_1$ and $R_2$ each represents a lower alkyl group, an alkyl group containing a sulfo group or a carboxyl group; $R_3$ represents a lower alkyl group; $X_1$ represents an anion; n1 and n2 each represents an integer 1 or 2; and m represents an integer 0 or 1, with the proviso that when the compound is an intramolecular salt, m represents 0.
Examples of such a compound include:
C-1
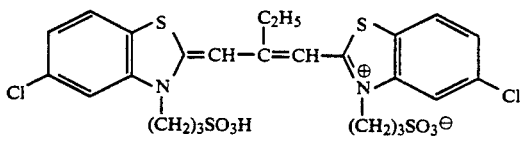
C-2
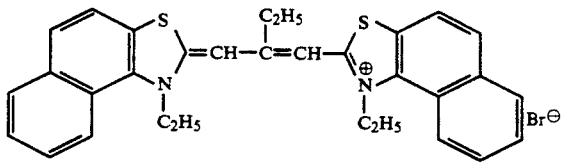
C-3
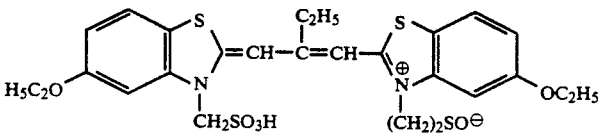
C-4
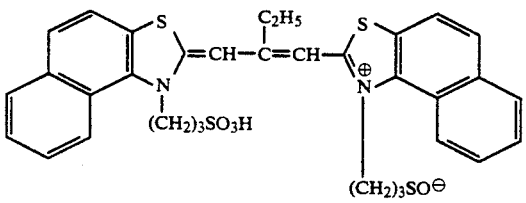
C-5
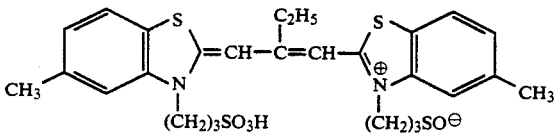
C-6
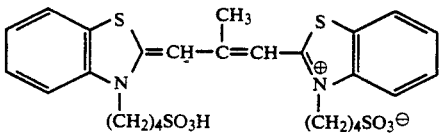
C-7
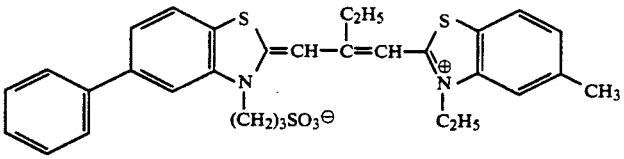
C-8
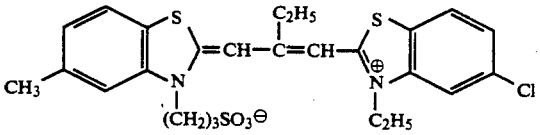
Examples of compound (D) include:
D-1
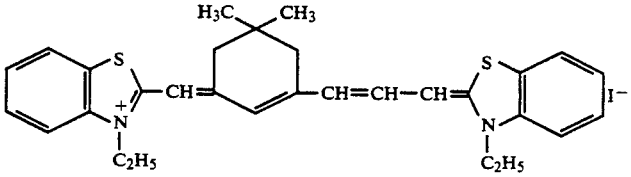

-continued

D-2

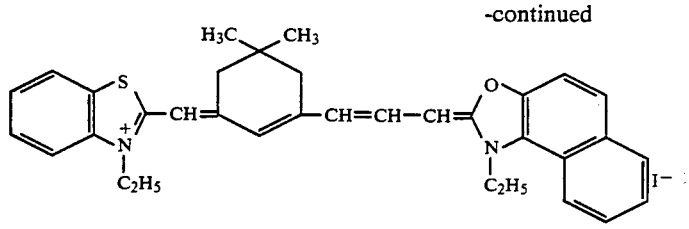

D-3

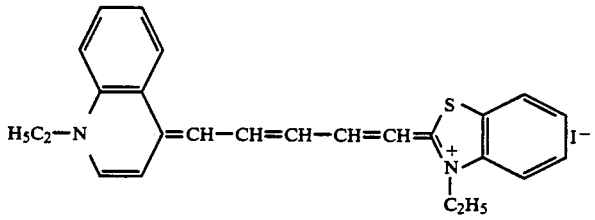

D-4

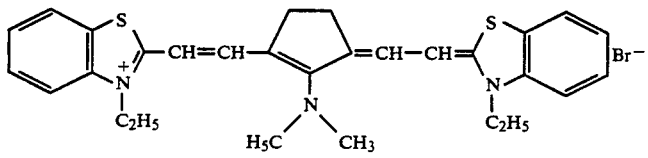

D-5

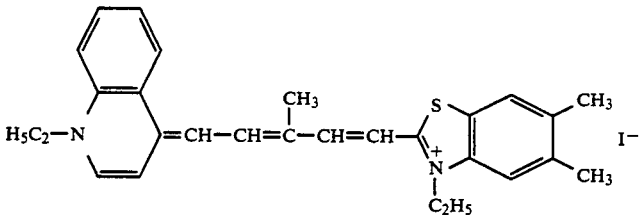

D-6

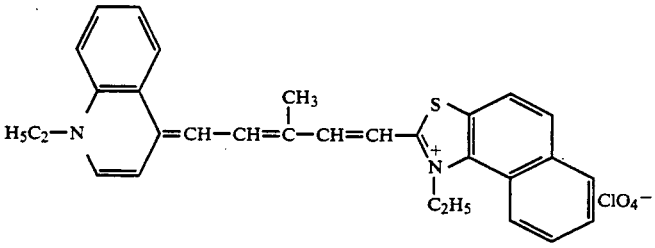

These sensitizing dyes may be used either singly or in combination. Combinations of these sensitizing dyes are frequently used particularly for the purpose of supersensization. In addition to these sensitizing dyes, the emulsion may comprise a dye which does not exhibit an effect of spectral sensitization itself or a substance which does not substantially absorb visible light, but does exhibit an effect of supersensitization.

Useful sensitizing dyes, combinations of dyes exhibiting an effect of supersensitization and substances exhibiting an effect of supersensitization are described in Research Disclosure No. 17643, vol. 176, December 1978, page 23, IV-J.

The photographic emulsion of the present invention may comprise various compounds for the purpose of inhibiting fog during the preparation, preservation or photographic processing of the light-sensitive material or for the purpose of stabilizing the photographic properties thereof. Examples of such compounds which may be incorporated in the photographic emulsion include the many compounds known as fog inhibitors and as stabilizers, such as azoles (e.g., benzothiazolium salt, nitroindazoles, chloro-benzimidazoles, bromobenzimidazoles, benzimidazoles, mercaptothiazoles, mercaptobenzothiazoles, mercaptothiadiazoles, aminotriazoles, benzothiazoles, and nitrobenzotriazoles), mercaptopyrimidines, mercapto-triazines, thioketo compounds (e.g., oxazolinethione), azaindenes (e.g., triazaindenes, tetrazaindenes (particularly 4-hydroxysubstituted (1,3,3a,7)tetraaza-indenes), pentaazaindenes), benzenethiosulfonic acids, benzenesulfinic acids, and benzenesulfonic amides.

In particular, polyhydroxybenzene compounds are preferable because they can improve pressure resistance without impairing sensitivity. Such polyhydroxybenzene compounds preferably have any of the following structures:

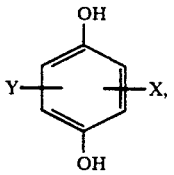

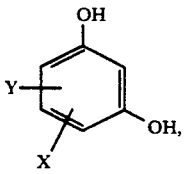

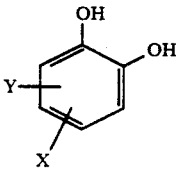

wherein X and Y each represents —H, —OH, a halogen atom, —OM (M is an alkaline metal ion), an alkyl group, a phenyl group, an amino group, a carbonyl group, a sulfone group, a sulfonated phenyl group, a sulfonated alkyl group, a sulfonated amino group, a sulfonated carbonyl group, a carboxyphenyl group, a carboxyalkyl group, an aromatic or aliphatic acylamino group, a hydroxyphenyl group, a hydroxyalkyl group, an alkylether (alkoxy) group, an alkylphenyl group, an alkylthioether group or a phenylthioether group. The groups represented by X and Y each preferably have carbon atoms of 1 to 8. The groups are preferably —H, —OH, —Cl, —Br, —COOH, $—CH_2CH_2COOH$, $—CH_3$, $—CH_2CH_3$, $—CH(CH_3)_2$, $—C(CH_3)_3$, $—OCH_3$, —CHO, $—SO_3Na$, $—SO_3H$, $—SCH_3$,

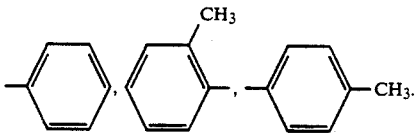

X and Y may be the same or different.

Particularly preferred examples of polyhydroxybenzene compounds include:

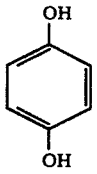

E-(1)

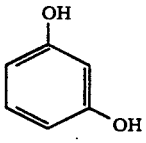

E-(2)

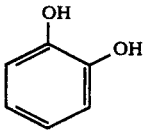

E-(3)

-continued

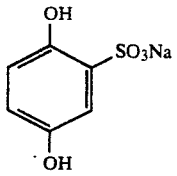

E-(4)

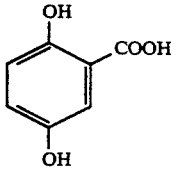

E-(5)

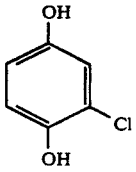

E-(6)

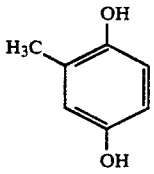

E-(7)

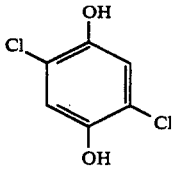

E-(8)

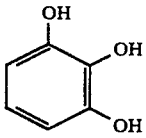

E-(9)

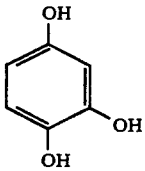

E-(10)

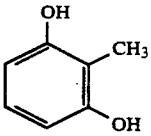

E-(11)

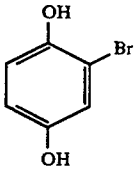

E-(12)

-continued

E-(13)

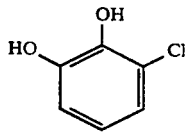

E-(14)

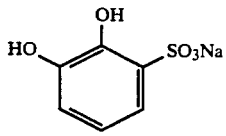

E-(15)

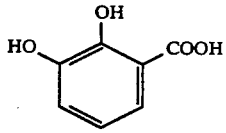

E-(16)

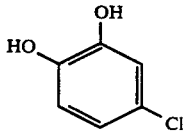

E-(17)

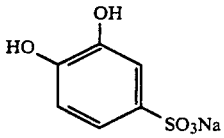

E-(18)

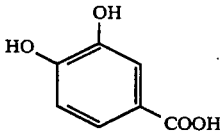

E-(19)

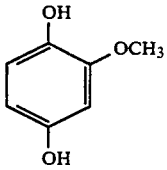

E-(20)

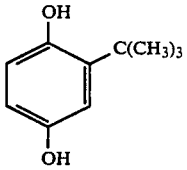

E-(21)

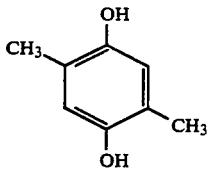

E-(22)

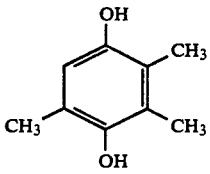

The polyhydroxybenzene compound may be incorporated into the emulsion layer or into an other layer in the light-sensitive material. The amount of the polyhydroxybenzene compound to be incorporated is preferably in the range of $10^{-5}$ to 1 mol per mol of silver halide, particularly $10^{-3}$ to $10^{-1}$ mol per mol of silver halide.

The light-sensitive material of the present invention may comprise water-soluble dyes in the hydrophilic colloidal layer as a filter dye. Or, it may be for another purpose, such as inhibiting irradiation. Examples of these water-soluble dyes include oxonol dyes, hemioxonol dyes, styryl dyes, merocyanine dyes, cyanine dyes, and azo dyes. Particularly useful are oxonol dyes, hemioxonol dyes, and melocyanine dyes.

For the purpose of raising sensitivity and contrast or for accelerating development, the photographic emulsion layer of the present photographic light-sensitive material may comprise a developing agent such as polyalkylene oxides or ether, ester or amine derivatives thereof, thioether compounds, thiomorpholines, quaternary ammonium salts, urethane derivatives, urea derivatives, imidazole derivatives, 3-pyrazolidones, and aminphenols.

Particularly preferred among these developing agents are 3-pyrazolidones (e.g., 1-phenyl-3-pyrazolidone, 1-phenyl-4-methyl-4-hydroxymethyl-3-pyrazolidone). Such a developing agent is normally used in the range of 5 $g/m^2$ or less, preferably 0.01 to 0.2 $g/m^2$ The present photographic emulsion or light-insensitive hydrophilic colloid may contain an inorganic or organic film hardener. For example, active vinyl compounds (e.g., 1,3,5-triacryloyl-hexahydro-s-triazine, bis(vinylsulfonyl)methylether, N,N-methylenebis-[β-(vinylsulfonyl)propionamide]), active halogen compounds (2,4-dichloro-6-hydroxy-s-triazine), mucohalogenic acids (mucochloric acid), N-carbamoylpyridinium salts (e.g., (1-morpholi)carbonyl-3-pyridinio)methane sulfonate), and haloamidinium salts (e.g., 1-(1-chloro-1-pyridinomethylene)pyrrolidinium, 2-naphthalene sulfonate) can be used either singly or in combination. In particular, the active vinyl compounds described in JP-A-53-41220, JP-A-53-57257, JP-A-59-162546, and JP-A-60-80846 and the active halogen compounds described in U.S. Pat. No. 3,325,287 are preferable.

The photographic emulsion layer or other hydrophilic colloid layers in the light-sensitive material prepared according to the present invention may contain any type of surface active agent for the purpose of facilitating coating and emulsion dispersion, inhibiting electric charging and adhesion, improving smoothness and photographic properties (e.g., acceleration of development, higher contrast, sensitization), or for similar purposes.

Examples of such surface active agents include (i) nonionic surface active agents such as saponin (steroid series), alkylene oxide derivatives (e.g., polyethylene glycol, polyethylene glycol/polypropylene glycol condensate, polyethylene glycol alkyl ether or polyethylene glycol alkylaryl ether, polyethylene glycol ester, polyethylene glycol sorbitan ester, polyalkylene glycol alkylamine or amide, polyethylene oxide addition product of silicone), glycidol derivatives (e.g., polyglyceride alkenylsuccinate, alkylphenol polyglyceride), an aliphatic ester of polyvalent alcohol, or an alkylester of saccharide, (ii) anionic surface active agents containing acid groups such as a carboxyl group, a sulfo group, a phospho group, an ester sulfate group or an ester phosphate group (e.g., alkylcarboxylate, alkylsulfonate, alkylbenzenesulfonate, alkylnaphthalenesulfonate, alkylsulfuric ester, alkylphosphoric ester, N-acyl-N-alkyltaurine, sulfosuccinic ester, sulfoalkyl polyoxyethylenealkyphenylether, polyoxyethylenealkylphosphoric ester), (iii) amphoteric surface active agents such as an amino acid, an aminoalkylsulfonic acid, an aminoalkylsulfuric or a phosphoric ester, an alkylbetaine and an amine oxide, and (iv) cationic surface active agents such as an alkylamine salt, an aliphatic or aromatic quaternary ammonium salt, a heterocyclic quaternary ammonium salt (e.g., pyridinium, imidazolium), and an aliphatic or heterocyclic group-containing phosphonium or sulfonium salt.

In order to provide an antistatic effect, the fluorine-containing surface active agents described in JP-A-60-80849 are preferable.

In the present photographic light-sensitive material, the photographic emulsion layer and other hydrophilic colloidal layers may comprise a matting agent such as silica, magnesium oxide and polymethyl methacrylate for the purpose of inhibiting adhesion.

The photographic emulsion layer or other hydrophilic colloid layers of the photographic light-sensitive material of the present invention may comprise a dispersion of a synthetic polymer which is insoluble or difficultly soluble in water for the purpose of improving dimensional stability. Examples of such a synthetic polymers include polymers of alkyl(meth)acrylate, alkoxyalkyl(meth)acrylate, glycidyl(meth)acrylate, either singly or in combination, and polymers comprising as monomer components combinations of at least one of these compounds with acrylic acid, methacrylic acid, or the like.

A suitable binder or protective colloid for the emulsion is gelatin. Other hydrophilic colloids may be used, such as protein such as gelatin derivatives, graft polymer of gelatin with other high molecular compounds, albumine, and casein, cellulose derivatives such as hydroxyethyl cellulose, carboxymethyl cellulose, cellulose sulfonic acid ester, sodium alginate, and sachaaride such as starch derivatives, homopolymers or copolymers such as polyvinyl alcohol, polyvinyl alcohol partical acetal, poly-N-vinyl pyrrolidone, polyacrylic acid, polymethacrylic acid, polyacrylamide, polyvinyl imidazole, and polyvinyl pyrazole, and other various synthetic hydrophilic high molecular weight compounds.

Lime-treated gelatin, and acid-treated gelatin may be used. Furthermore, hydrolytic decomposition products of gelatin and enzymatic decomposition products of gelatin may be used.

The silver halide emulsion of the present invention can comprise a polymer latex such as alkyl acrylate.

Examples of the support materials which can be used in the present light-sensitive material include cellulose triacetate, cellulose diacetate, nitrocellulose, polystyrene, polyethylene terephthalate paper, baryta-coated paper, and polyolefin-coated paper.

The developing agent for the developer to be used with the present invention is not specifically limited. Dihydroxybenzenes are preferably used because they easily provide an excellent dot quality. A combination of dihydroxybenzenes and 1-phenyl-3-pyrazolidones or a combination of dihydroxybenzenes and p-aminophenols may be used.

Examples of dihydroxybenzene developing agents which can be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Particularly preferred among these dihydroxybenzene developing agents is hydroquinone.

Examples of the 1-phenyl-3-pyrazolidone developing agents or derivatives thereof which can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, -p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

Examples of the p-aminophenolic developing agents which can be used in the present invention include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Particularly preferred among these compounds is N-methyl-p-aminophenol.

In general, the developing agent is preferably in an amount of 0.05 to 0.8 mol/l. If a combination of dihydroxybenzenes and 1-phenyl-3-pyrazolidones or p-aminophenols is used, the former is preferably in an amount of 0.05 to 0.5 mol/l and the latter is preferably in an amount of 0.06 mol/l or less.

Examples of the sulfite preservatives which can be used in the present invention include sodium sulfite, potassium sulfite, lithium sulfite, ammonium sulfite, sodium bisulfite, potassium metabisulfite, and sodium formaldehyde bisulfite. Such a sulfite may be preferably used in an amount of 0.3 mol/l or more, particularly 0.4 mol/l or more. The preferred upper limit of the amount of the sulfite is 2.5 mol/l, more preferred is 1.2 mol/l.

Alkali agents which can be used to adjust the pH value of the system include pH adjustors and buffers such as sodium hydroxide, potassium hydroxide, sodium carbonate, potassium carbonate, sodium tertiary phosphate, potassium tertiary phosphate, sodium silicate and potassium silicate.

Additives other than the above mentioned components include compounds such as boric acid and borax, development restrainers such as sodium bromide, potassium bromide and potassium iodide, organic solvents such as ethylene glycol, diethylene glycol, triethylene glycol, dimethyl formamide, methyl cellosolve, hexylene glycol, ethanol and methanol, and fog inhibitors such as mercapto compounds (e.g., 1-phenyl-5-mercaptotetrazole, sodium 2-mercaptobenzimidazole-5-sulfonate), indazole compounds (e.g., 5-nitroindazole) and benztriazole compounds (e.g., 5-methylbenztriazole). Further, toners, surface active agents, anti-foaming agents, water softners, and film hardeners may be used as necessary. In particular, the amino compounds described in JP-A-56-106244 and the imidazole compounds described in JP-B-48-35493 are preferred used in view of improvements they cause in development or sensitivity.

The developer for the present invention may contain the compounds described in JP-A-56-24347 as silver stain inhibitors, the compounds described in JP-A-62-212651 as uniform development, and the compounds described in JP-A-61-267759 as dissolution aids.

The fixing solution for the present invention is an aqueous solution containing fixing agents as well as film hardeners (e.g., water-soluble aluminum compound), acetic acid and dibasic acids (e.g., tartaric acid, citric acid and salts thereof), if desired, preferably has a pH value of 3.8 or more, more preferably 4.0 to 5.5.

The fixing agents may be sodium thiosulfate and ammonium thiosulfate. Particularly preferred among these fixing agents is ammonium thiosulfate in view of its fixing speed. The amount of the fixing agent to be used can be altered, but is normally in the range of about 0.1 to about 5 mol/l.

The water-soluble aluminum salts to be incorporated in the fixing solution as film hardeners include those compounds which are generally known as film hardeners for acidic film-hardening fixing solution. Examples of such compounds include aluminum chloride, aluminum sulfate, and potassium alum.

The above mentioned dibasic acids include tartaric acid or derivatives thereof, or citric acid or derivatives thereof, either singly or in combination. These compounds are preferably incorporated in an amount of 0.005 mol or more, particularly 0.01 to 0.03 mol, per l of the fixing solution.

Examples of the dibasic acids include tartaric acid, potassium tartrate, sodium tartrate, potassium sodium tartrate, ammonium tartrate, ammonium potassium tartrate, citric acid or the derivatives thereof, such as sodium citrate, and potassium citrate are effective in the present invention.

The fixing solution may further comprise preservatives (e.g., sulfite, bisulfite), pH buffers (e.g., acetic acid, boric acid), pH adjustors (e.g., ammonia, sulfuric acid), image storage improvers (e.g., potassium iodide), and chelating agents, if desired. Since the pH value of the developer is high, the pH buffers are preferably in an amount of 10 to 40 g/l, more preferably 18 to 25 g/l.

The light-sensitive material according to the present invention exhibits excellent, rapid developability when processed by means of an automatic developing machine which operates preferably in a total processing time of 20 to 60 seconds.

In the rapid development process of the present invention, the development and fixing steps are each effected preferably at a temperature of about 25° to 50° C. for 25 seconds or less, more preferably at a temperature of 30° to 40° C. for 6 to 15 seconds.

In the present invention, the light-sensitive material which has been subjected to development and fixing is then subjected to washing with water or stabilization. The washing step can be effected in a 2 or 3 steps of countercurrent process to save water. When the washing step is effected with a small amount of washing water, a squeeze roller washing bath is preferably provided. Furthermore, the overflow solution from the washing bath or stabilizing bath can be partially or entirely reused as a fixing solution as described in JP-A-60-235133. These approaches enable a reduction in the amount of waste water.

The washing water may contain an anti-fungal agent (e.g., compounds as described in Horiguchi, "Bokin Bobai no Kagaku" and JP-A-62-115154), a washing accelerator (e.g., sulfite), a chelating agent or the like.

In the above mentioned process, washing or stabilization may be effected preferably at a temperature of 0° to 50° C. for 5 to 30 seconds, more preferably at a temperature of 15° C. to 40° C. for 5 to 20 seconds.

In the present invention, the light-sensitive material which has been subjected to development, fixing and washing is then dried via a squeeze roller. The drying is effected preferably at a temperature of 40° C. to 80° C. for 5 to 30 seconds.

The term "total processing time" as used herein means the time between the point at which the leading edge of the film is introduced into the inlet of the automatic developing machine and the point at which the leading edge of the film comes out of the outlet of the drying section machine via a developing bath, a connecting section, a fixing bath, a connecting section, a washing bath, a connecting section and a drying section.

The present invention will be further described in the following examples, but the present invention should not be construed as being limited thereto.

EXAMPLE 1

| Preparation of Emulsion $A_1$ | |
|---|---|
| Solution 1: | |
| Water | 1.0 l |
| Gelatin | 20 g |
| Sodium chloride | 20 g |
| 1,3-Dimethylimidazolidine-2-thione | 20 mg |
| Present Compound (1) mentioned above | stated in Table 1 |
| Solution 2: | |
| Water | 400 l |
| Silver nitrate | 100 g |
| Solution 3: | |
| Water | 400 l |
| Sodium chloride | 30.5 g |
| Potassium bromide | 14.0 g |
| Potassium hexachloroiridate (III) (0.001% aqueous solution) | 15 ml |
| Ammonium hexabromorhodate (III) (0.001% aqueous solution) | 1.5 ml |

Solution 2 and Solution 3 were simultaneously added to Solution 1, which had been kept at a temperature of 38° C. and a pH of 4.5, with stirring over a period of 10 minutes to form nucleus grains with a size of 0.16 μm. Subsequently, Solution 4 and Solution 5, which are described later, were added to the system over a period of 10 minutes. Further, 0.15 g of potassium iodide was added to finish the formation of grains.

| | |
|---|---|
| Solution 4: | |
| Water | 400 l |
| Silver nitrate | 100 g |
| Solution 5: | |
| Water | 400 l |
| Sodium chloride | 30.5 g |
| Potassium bromide | 14.0 g |
| Compound identified in Table 1 | |

The emulsion was then washed with water by an ordinary flocculation method. 30 g of gelatin was added to the emulsion. The emulsion was adjusted to a pH of 5.1 and a pAg of 7.5. The emulsion was then subjected to chemical sensitization with 8 mg of sodium thiosulfate and 12 mg of chloroauric acid at a temperature of 65° C. to obtain an optimum sensitivity. 200 mg of 2-methyl-4-hydroxy-1,3,3*a*,7-tetrazaindene was added to the emulsion as a stabilizer. As a result, an emulsion of cubic silver bromochloroiodide grains having an average diameter of 0.20 μm and containing 80 mol% of silver chloride was obtained (fluctuation coefficient: 9)).

Furthermore, 100 ppm of phenoxy ethanol was added to the emulsion as a preservative.

Preparation of Emulsion $B_1$:

An emulsion of cubic silver bromochloroiodide grains having an average diameter of 0.19 μm and containing 50 mol% of silver chloride was prepared as Emulsion B in the same manner as Emulsion $A_1$ except that the sodium chloride and potassium bromide contained in Solution 3 and Solution 5 were present in amounts of 20.2 g and 35.1 g, respectively.

Preparation of Comparative Emulsion $C_1$

An emulsion of cubic silver bromochloroiodide grains having an average diameter of 0.18 μm and containing 20 mol% of silver chloride was prepared as Comparative Emulsion $C_1$ in the same manner as Emulsion $A_1$ except that the sodium chloride and potassium bromide contained in Solution 3 and Solution 5 were present in amounts of 9.9 g and 56 g, respectively.

Preparation of coat specimen

The emulsions thus prepared were then subjected to infrared sensitization with 30 mg per mol of Ag of an infrared sensitizing dye D-5. To these emulsions were added disodium 4,4'-bis(4,6-dinaphthoxy-pyrimidine-2-ylamino)-stilbenzylsulfonate and iodide salt of 2,5-dimethyl-3-allylbenzothiazole in amounts of 300 mg and 450 mg per mol of silver, respectively, for the purpose of supersensitization and stabilization.

To these emulsions were added hydroquinone in the amount of 100 mg/m², a polyethyl acrylate latex in the amount of 25% based on the gelatin binder, and 2-bis(-vinylsulfonylacetamido)ethane as film hardener in the amount of 86 mg/m². These emulsions were each coated on a polyester support in an amount so that the amounts of silver and gelatin were 3.0 mg/m² and 1.0 g/m², respectively.

On these materials was coated an upper protective layer comprising 0.3 g/m² of gelatin, 60 mg/m² of a polymethyl methacrylate having a grain diameter of 2.5 μm as matting agent, 70 mg/m² of colloidal silica having a grain diameter of 10 μm, sodium dodecylbenzenesulfonate as coating aid, and a fluorine-containing surface active agent having the following structural formula (i). Also applied was a lower protective layer comprising 0.4 g/m² of gelatin, 225 mg/m² of a polyethyl acrylate latex, 10 mg/m² of a dye having the following structural formula (ii), 20 mg/m² of a dye having the following structural formula (iii), and sodium dodecylbenzenesulfonate as coating aid.

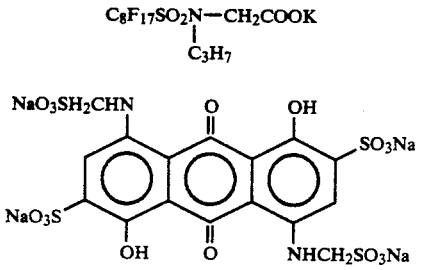

-continued

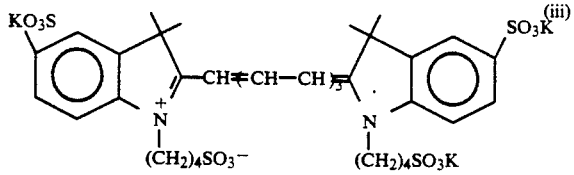

The back layer and back protective layer used in the present example had the following compositions:

| | |
|---|---|
| Back layer | |
| Gelatin | 2.0 g/m² |
| Sodium dodecylbenzenesulfonate | 80 mg/m² |
| Dye (iii) | 70 mg/m² |
| Dye (iv) | 85 mg/m² |
| Dye (v) | 90 mg/m² |
| 1,3-Divinylsulfone-2-propanol | 60 mg/m² |
| Back protective layer | |
| Gelatin | 0.5 mg/m² |
| Polymethyl methacrylate (grain size: 4.7 μm) | 30 mg/m² |
| Sodium dedecylbenzenesulfonate | 20 mg/m² |
| Fluorine-containing surface active agent (i) | 2 mg/m² |
| Silicone oil | 100 mg/m² |

(iv)

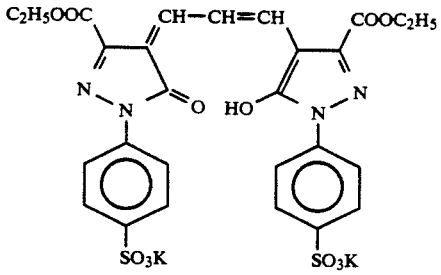

(v)

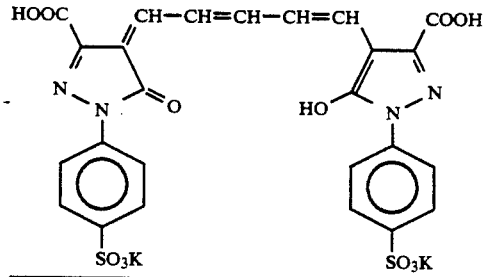

Evaluation of photographic properties

These specimens were exposed to light through an interference filter with a peak at 780 nm and a continuous wedge from a xenon flash for an emission time of $10^{-6}$ sec. They were then subjected to sensitometry by means of an automatic developing machine FG-710NH available from Fuji Photo Film Co., Ltd. at the temperatures described below for the times described below.

As the developer and the fixing solution there were used LD835 and LF308 available from Fuji Photo Film Co., Ltd., respectively.

| | | |
|---|---|---|
| Development | 38° C. | 14 sec. |
| Fixing | 37° C. | 9.7 sec. |
| Washing with water | 26° C. | 9 sec. |
| Squeeze | | 2.4 sec. |

-continued

| | | |
|---|---|---|
| Drying | 55° C. | 8.3 sec. |
| Total | | 43.4 sec |

The sensitivity value is represented as the reciprocal of the exposure which gives a density of 3.0. The sensitivity values relative to the reference value are set forth in Table 1. The gradation is represented as the gradient of the straight line between the density of 0.1 and the density of 3.0 on the characteristic curve. The results are set forth in Table 1.

TABLE 1

| No. | Emulsion | Amount of Compound (1) (mg) | Compound of Solution 5 Type | Compound of Solution 5 mol/Ag* mol | Photographic properties Sensitivity | Photographic properties Gradation | Photographic properties Fog |
|---|---|---|---|---|---|---|---|
| 1 | $A_1$ | — | — | — | 100 | 6.0 | 0.05 |
| 2 | " | 5 | — | — | 95 | 6.2 | 0.04 |
| 3 | " | 10 | — | — | 90 | 6.4 | " |
| 4 | " | — | $K_4Fe(CN)_6$ | $1 \times 10^{-5}$ | 135 | 5.5 | 0.06 |
| 5 | " | 5 | " | " | " | 6.5 | 0.04 |
| 6 | " | 10 | " | " | 130 | 7.0 | " |
| 7 | " | — | " | $3 \times 10^{-5}$ | 160 | 5.2 | 0.07 |
| 8 | " | 5 | " | " | 160 | 6.4 | 0.04 |
| 9 | " | — | $K_2Re(CN)_6$ | $1 \times 10^{-5}$ | 130 | 5.8 | 0.07 |
| 10 | " | 5 | " | " | 130 | 6.8 | 0.04 |
| 11 | " | — | $K_2Os(CN)_6$ | " | 135 | 5.0 | 0.07 |
| 12 | " | 5 | " | " | 134 | 6.4 | 0.04 |
| 13 | " | — | $K_2Ru(CN)_6$ | " | 130 | 5.3 | 0.07 |
| 14 | " | 5 | " | " | 128 | 6.6 | 0.04 |
| 15 | " | — | $FeCl_2$ | " | 125 | 5.8 | 0.06 |
| 16 | " | 5 | " | " | 123 | 6.5 | 0.04 |
| 17 | " | " | " | $3 \times 10^{-5}$ | 135 | 6.8 | 0.04 |
| 18 | $B_1$ | — | — | — | 105 | 5.7 | 0.06 |
| 19 | " | — | $K_4Fe(CN)_6$ | $1 \times 10^{-5}$ | 140 | 5.4 | 0.08 |
| 20 | " | 5 | " | " | 140 | 6.4 | 0.04 |
| 21 | " | " | " | $3 \times 10^{-5}$ | 150 | 6.2 | 0.04 |
| 22 | " | " | $K_2Os(CN)_6$ | $1 \times 10^{-5}$ | 135 | 6.3 | 0.04 |
| 23 | $C_1$ | — | — | — | 90 | 5.0 | 0.05 |
| 24 | " | — | $K_4Fe(CN)_6$ | $1 \times 10^{-5}$ | 95 | 4.5 | 0.07 |
| 25 | " | 5 | " | " | 90 | 4.7 | 0.06 |
| 26 | " | " | " | $3 \times 10^{-5}$ | 90 | 4.7 | 0.06 |

(Note:
Emulsion Nos. 5, 6, 8, 10, 12, 14, 16, 17, 20, 21, and 22 are according to the present invention.
*Ag in AgX formed in emulsion (the same hereinafter)

It can be appreciated from Table 1 that Specimens 5, 6, 8, 10, 12, 14, 16, 17, and 20 to 22 according to the present invention exhibit a high sensitivity and contrast and little fog.

EXAMPLE 2

Specimens were prepared in the same manner as Emulsion $A_1$ except that the compounds identified in Table 2 were used in the amounts set forth in Table 2, instead of Compound (1), for Solution 1. Further, the compounds identified in Table 2 were used instead of the compound for Solution 5 identified in Table 1. The results of photographic properties of these specimens are set forth in Table 2.

TABLE 2

| No. | Compound of Solution 1 Type | Compound of Solution 1 mg | Compound of Solution 5 Type | Compound of Solution 5 mol/Ag* mol | Photographic properties Sensitivity | Photographic properties Gradation | Photographic properties Fog |
|---|---|---|---|---|---|---|---|
| 1 | — | — | — | — | 100 | 6.0 | 0.05 |
| 2 | — | — | $K_4Fe(CN)_6$ | $1 \times 10^{-5}$ | 140 | 5.5 | 0.06 |
| 3 | (2) | 5 | " | " | 140 | 6.5 | 0.04 |
| 4 | " | 10 | " | " | 138 | 6.8 | " |
| 5 | (4) | 5 | " | " | 139 | 6.3 | " |
| 6 | " | 10 | " | " | 138 | 6.5 | " |
| 7 | (7) | 5 | " | " | 139 | 6.5 | " |
| 8 | " | 10 | " | " | 138 | 6.5 | " |

TABLE 2-continued

| No. | Compound of Solution 1 Type | Compound of Solution 1 mg | Compound of Solution 5 Type | Compound of Solution 5 mol/Ag* mol | Photographic properties Sensitivity | Photographic properties Gradation | Photographic properties Fog |
|---|---|---|---|---|---|---|---|
| 9 | (9) | 5 | " | " | 140 | 6.2 | " |
| 10 | " | 10 | " | " | 140 | 6.4 | " |
| 11 | (4) | 10 | $K_2Os(CN)_6$ | " | 135 | 6.3 | " |
| 12 | " | 20 | " | " | 135 | 6.5 | " |
| 13 | (12) | 5 | " | " | 140 | 6.5 | " |
| 14 | " | 10 | " | " | 140 | 6.5 | " |

Note:
Specimen Nos. 3 to 14 are according to the present invention.)

EXAMPLE 3

The improvements in rapid processability provided by the present invention will be described hereinafter.

The line speed of FG-710NH was reduced. The time from development to drying were each increased 1.7 times, totalling 73.8 seconds. The specimens in Example 1 were then evaluated. The difference in photographic properties from Example 1 are set forth in Table 3.

TABLE 3

| No. | Difference in Sensitivity | Difference in gradation | |
|---|---|---|---|
| 1 | 20 | 0.5 | |
| 2 | 18 | 0.4 | |
| 4 | 25 | 0.6 | |
| 5 | 3 | 0 | (present invention) |
| 6 | 5 | 0.1 | (present invention) |
| 10 | 5 | 0.1 | (present invention) |
| 12 | 5 | 0.1 | (present invention) |
| 16 | 8 | 0.2 | (present invention) |
| 18 | 25 | 0.6 | |
| 21 | 6 | 0.1 | (present invention) |
| 23 | 35 | 0.8 | |

TABLE 3-continued

| No. | Difference in Sensitivity | Difference in gradation |
|---|---|---|
| 25 | 20 | 0.5 |

The sensitivity difference is obtained by subtracting the sensitivity value obtained at a total processing time of 43.4 seconds from that obtained at a total processing time of 73.8 seconds. The gradation difference is obtained by subtracting the gradation value obtained at a total processing time of 43.4 seconds from that obtained at a total processing time of 73.8 seconds.

It can be appreciated from Table 3 that the present invention accomplishes superior photographic effects upon rapid processing.

EXAMPLE 4

Specimens were prepared in the same manner as in Emulsion $A_1$ except that the compounds for Solutions 1 and 5 were altered as shown in Table 4.

Furthermore, the sensitizing dyes to be added upon the preparation of coat specimens were altered as set forth in Table 4. The evaluation of photographic properties was made in the same manner as in Example 1 except that the peak in the interference filter was altered as indicated in Table 4. The results are set forth in Table 4. When sensitizing dyes suitable for any scanner light sources were used, these specimens still exhibit excellent properties.

TABLE 4

| No. | Amount of Compound (1) in Solution 1 | Compound of Solution 5 Type | Compound of Solution 5 mol/mol · Ag* | Sensitizing dye mg/mol · Ag | Interference filter peak | Photographic properties Sensitivity | Gradation | Fog |
|---|---|---|---|---|---|---|---|---|
| 1 | — | — | — | A-1) 200 | 488 nm | 100 | 5.3 | 0.04 |
| 2 | — | $K_4Fe(CN)_6$ | $1 \times 10^{-5}$ | " | " | 140 | 6.5 | 0.07 |
| 3 | 5 | " | " | " | " | 138 | 6.7 | 0.04 |
| 4 | — | — | — | B-2) 100 | 633 nm | 100 | 5.3 | 0.05 |
| 5 | — | $K_4Fe(CN)_6$ | $1 \times 10^{-5}$ | " | " | 150 | 6.3 | 0.08 |
| 6 | 5 | " | " | " | " | 148 | 6.5 | 0.05 |
| 7 | — | — | — | C-1/C-4, 100/100 | 670 nm | 100 | 5.3 | 0.06 |
| 8 | — | $K_4Fe(CN)_6$ | $1 \times 10^{-5}$ | " | " | 138 | 6.4 | 0.09 |
| 9 | 5 | " | " | " | " | 138 | 6.4 | 0.05 |

(Specimen Nos. 3, 6 and 9 are according to the present invention.)

EXAMPLE 5

Emulsion $A_2$ was prepared in the same manner as Example 1 except 6 mg of sodium benzenethiosulfonate was used instead of Compound (1) in Solution 1, and $K_4Fe(CN)_6$ was used in Solution 5 in an amount shown in Table 5 instead of compound and amounts in Solution 5 shown in Table 1 in Example 1.

The emulsions thus obtained each divided into four lots. These lots were adjusted so that the pH thereof reached those shown in Table 5 and so that the pAg value thereof reached 7.5. These emulsions were then subjected to chemical sensitization with 2 mg of sodium thiosulfate and 3 mg of chloroauric acid at a temperature of 65° C to obtain an optimum sensitivity. 50 mg of 2-methyl-4-hydroxy-1,3,3a,7-tetrazaindene (as stabilizer) and 1,000 ppm of phenoxyethanol (as preservative) were added to these emulsions. As a result, emulsions of cubic silver bromochloroiodide grains having an average diameter of 0.20 μm and a silver chloride content of 80 mol% were obtained (fluctuation coefficient: 9%).

Preparation of Emulsion $B_2$

An emulsion of cubic silver bromochloroiodide grains having an average diameter of 0.19 μm and a silver chloride content of 50 mol% was prepared in the same manner as Emulsion $A_2$ except that the amounts of sodium chloride and potassium bromide incorporated in Solutions 3 and 5 were altered to 20.2 g and 35.1 g, respectively.

Preparation of Comparative Emulsion $C_2$

An emulsion of cubic silver bromochloroiodide grains having an average diameter of 0.18 μm and a silver chloride content of 20 mol% was prepared in the same manner as Emulsion $A_2$ except that the amounts of sodium chloride and potassium bromide incorporated in Solutions 3 and 5 were altered to 9.9 g and 56 g, respectively.

Preparation of coat specimens 100 mg/mol.Ag of spectral sensitizing dyes C-1 and C-4 were added to these emulsions. Hydroquinone and 1-phenyl-5-mercaptotetrazole were added as fog inhibitors to these emulsions in amounts of 2.5 g and 50 mg, respectively. A polyethyl acrylate latex was added as plasticizer to these emulsions in the amount of 25% based on the gelatin binder. 2-Bis(vinylsulfonylacetamide)ethane was added as a film hardener to these emulsions. These emulsions were then each coated on a polyester support in an amount so that the amounts of silver and gelatin reached 3.0 g/m² and 1.0 g/m², respectively. On these materials were simultaneously coated an upper protective layer and a lower protective layer having the following compositions:

| | per m² |
|---|---|
| Lower protective layer | |
| Gelatin | 0.5 g |
| Dye 1 (shown below) | 250 mg |
| Sodium benzenethiosulfonate | 4 mg |
| 1,5-Dihydroxy-2-benzaldoxim | 25 mg |
| Polyethyl acrylate latex | 160 mg |
| Dye 1 | |

-continued

| | per m² |
|---|---|

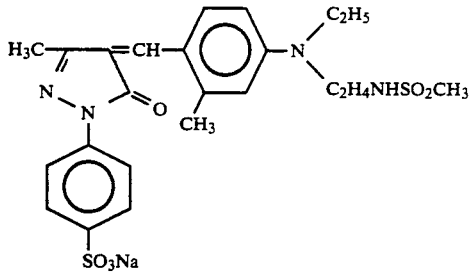

Upper protective layer

| | |
|---|---|
| Gelatin | 0.4 g |
| Silica matting agent (average grain diameter: 2.5 μm) | 150 mg |
| Silicone oil | 100 mg |
| Colloidal silica (grain diameter: 10 μm) | 30 mg |
| Compound 2 (shown below) | 5 mg |
| Sodium dodecylbenzenesulfonate | 22 mg |

Compound 2

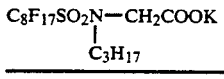

The support used in this example had a back layer and back protective layer the same as Example 1 except that Compound 3 shown below was used instead of the dye having formula (iii).

Compound 3

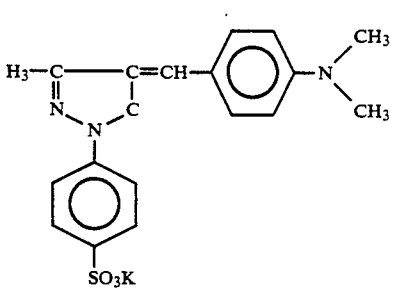

Evaluation of photographic properties

Evaluation of the photographic properties of specimens thus obtained was conducted in the same manner as Example 1 except that the interference filter had a peak at 670 nm. The results are set forth in Table 5.

TABLE 5

| No. | Emulsion | $K_4Fe(CN)_6$ (mol/Ag*mol) | pH at chemical Sensitization | Photographic Properties: Sensitivity | Gradation | Fog |
|---|---|---|---|---|---|---|
| 1 | $A_2$ | — | 6.2 | 100 | 6.0 | 0.10 |
| 2 | " | — | 5.8 | 98 | 5.9 | 0.10 |
| 3 | " | — | 5.5 | 100 | 6.1 | 0.10 |
| 4 | " | — | 5.1 | 102 | 5.8 | 0.10 |
| 5 | " | $1 \times 10^{-5}$ | 6.2 | 125 | 5.5 | 0.12 |
| 6 | " | " | 5.8 | 128 | 5.6 | 0.11 |
| 7** | " | " | 5.5 | 135 | 5.9 | 0.10 |
| 8** | " | " | 5.1 | 140 | 6.2 | 0.10 |
| 9 | " | $3 \times 10^{-5}$ | 6.2 | 150 | 5.2 | 0.14 |
| 10 | " | " | 5.8 | 150 | 5.5 | 0.12 |
| 11** | " | " | 5.5 | 165 | 5.8 | 0.10 |
| 12** | " | " | 5.1 | 170 | 6.1 | 0.10 |
| 13 | $B_2$ | — | 5.8 | 105 | 5.6 | 0.10 |
| 14 | " | — | 5.1 | 105 | 5.5 | 0.10 |
| 15 | " | $3 \times 10^{-5}$ | 6.2 | 145 | 5.0 | 0.14 |
| 16 | " | " | 5.8 | 145 | 5.3 | 0.13 |
| 17** | " | " | 5.5 | 160 | 5.7 | 0.11 |
| 18** | " | " | 5.1 | 165 | 5.9 | 0.10 |
| 19 | $C_2$ | — | 5.8 | 90 | 4.5 | 0.10 |
| 20 | " | — | 5.1 | 90 | 4.7 | 0.10 |
| 21 | " | $3 \times 10^{-5}$ | 6.2 | 95 | 4.5 | 0.13 |
| 22 | " | " | 5.8 | 95 | 4.6 | 0.12 |
| 23 | " | " | 5.5 | 94 | 4.5 | 0.13 |
| 24 | " | " | 5.1 | 97 | 4.7 | 0.10 |

**(invention)

It can be appreciated from Table 5 that Specimens 7, 8, 11, 12, 17 and 18 according to the present invention exhibit a high contrast and less formation of fog.

EXAMPLE 6

An experiment was conducted in the same manner as Example 5 except that the compounds identified in Table 6 were used instead of $K_4Fe(CN)_6$ for incorporation into Solution 5 in Emulsion $A_2$. The results are set forth in Table 6.

TABLE 6

| No. | Compound of Solution 5: Type | mol/Ag*mol | pH at chemical sensitization | Photographic Properties: Sensitivity | Gradation | Fog |
|---|---|---|---|---|---|---|
| 25 | $K_2Re(CN)_6$ | $3 \times 10^{-5}$ | 5.8 | 150 | 5.4 | 0.12 |
| 26** | " | " | 5.1 | 168 | 5.9 | 0.10 |
| 27 | $K_2Os(CN)_6$ | " | 6.2 | 145 | 5.0 | 0.14 |
| 28 | " | " | 5.8 | 150 | 5.2 | 0.12 |
| 29** | " | " | 5.5 | 162 | 5.5 | 0.10 |
| 30** | " | " | 5.1 | 169 | 5.7 | 0.10 |
| 31 | $K_2Ru(CN)_6$ | " | 5.8 | 145 | 4.9 | 0.13 |
| 32** | " | " | 5.1 | 159 | 5.5 | 0.10 |
| 33 | $FeCl_2$ | " | 5.8 | 135 | 4.7 | 0.12 |
| 34** | " | " | 5.1 | 150 | 5.3 | 0.10 |

**(invention)

EXAMPLE 7

In order to show the improvements in rapid processability provided by the present invention, the same experiment as Example 3 was conducted using specimens obtained in Example 5. The results are set forth in Table 7.

It can be appreciated from Table 7 that Specimens 7, 8, 17 and 18 according to the present invention exhibit less differences in both of sensitivity and gradation.

TABLE 7

| No. | Difference in Sensitivity | Difference in Gradation | |
|---|---|---|---|
| 1 | 20 | 0.5 | |
| 2 | 18 | 0.4 | |
| 3 | 15 | 0.6 | |
| 4 | 18 | 0.4 | |
| 5 | 15 | 0.6 | |
| 6 | 10 | 0.4 | |
| 7 | 5 | 0.2 | (invention) |
| 8 | 8 | 0.1 | (invention) |
| 14 | 25 | 0.7 | |
| 17 | 6 | 0.2 | (invention) |
| 18 | 5 | 0.2 | (invention) |
| 24 | 20 | 0.8 | |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer containing silver halide grains, wherein said silver halide grains have a silver chloride content of 30 mol% or more and contain (i) an iridium compound in an amount of $10^{-6}$ mol or less per mol of silver halide, (ii) at least one compound selected from the group consisting of iron, rhenium, ruthenium and osmium compounds in an amount of $10^{-3}$ mol or less per mol of silver halide, and (iii) (a) at least one compound selected from the group consisting of compounds represented by general formula (1-a), (1-b) and (1-c):

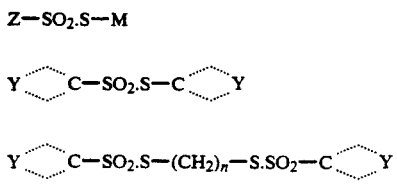

wherein Z represents a $C_{1-18}$ alkyl group, a $C_{6-18}$ aryl group or a heterocyclic group; Y represents an atomic group required for the formation of a $C_{6-18}$ aromatic ring or a heterocyclic ring, said groups or rings represented by Z or formed by Y may be substituted with at least one substituent; M represents a metallic atom or organic cation; and n represents an integer from 2 to 10, and/or (b) the silver halide grains have been chemically sensitized at a pH of 5.5.or less.

2. The silver halide photographic material as in claim 1, wherein the silver halide in the silver halide emulsion contains silver chloride, silver chlorobromide, or silver chloroiodo-bromide.

3. The silver halide photographic material as in claim 1, wherein the iridium compound is selected from the group consisting of halogenated iridium (III) compounds, halogenated iridium compounds (IV), iridium complex salts containing ligands selected from the group consisting of halogen, amines and oxalate.

4. The silver halide photographic material as in claim 1, wherein the total amount of the iridium compound is in the range of $1\times10^{-8}$ to $1\times10^{-6}$ mol per mol of silver halide in the silver halide emulsion.

5. The silver halide photographic material as in claim 1, wherein the iron compound is selected from the group consisting of divalent and trivalent iron ion containing salts and complex salts.

6. The silver halide photographic material as in claim 1, wherein said at least one of the rhenium compounds, ruthenium compounds and osmium compounds is a hexadentate complex.

7. The silver halide photographic material as in claim 1, wherein said at least one of the rhenium compounds, ruthenium compounds and osmium compounds is represented by general formula $[M(CN)_{6-y}Ly]^n$ wherein M represents rhenium, ruthenium or osmium; L represents a bridging ligand; y represents an integer 0, 1 or 2; and n represents -2, -3 or -4.

8. The silver halide photographic material as in claim 1, wherein the amount of said at least one compound selected from the group consisting of iron, rhenium, ruthenium and osmium compounds the rhenium compounds, ruthenium compounds and osmium compounds is not less than $10^{-6}$ mol per mol of the silver halide in the silver halide emulsion.

9. The silver halide photographic material as in claim 1, wherein said substituent in general formula (1-a), (1-b) and (1-c) is selected from the group consisting of lower alkyl groups, aryl groups, alkoxy groups containing 1 to 8 carbon atoms, halogen atoms, a nitro group, amino groups, amido groups and a carboxyl group.

10. The silver halide photographic material as in claim 1, wherein said heterocyclic group represented by Z or said heterocyclic ring formed by Y is selected from the group consisting of a thiazole ring, a benzthiazole ring, an imidazole ring, a benzimidazole ring, a tetrazole ring and an oxazole ring.

11. The silver halide photographic material as in claim 1, wherein the metallic atom represented by M is an alkali metal.

12. The silver halide photographic material as in claim 1, wherein the amount of said at least one compound represented by formula (1-a), (1-b) and (1-c) is in the range of 0.001 to 1 g per mol of silver halide in the silver halide emulsion.

13. The silver halide photographic material as in claim 1, wherein said silver halide grains in the silver halide emulsion have been chemically sensitized at a pH of 5.2 or less.

14. The silver halide photographic material as in claim 1, wherein said silver halide grains in the silver halide emulsion have been chemically sensitized at a pH of not less than 4.5.

15. The silver halide photographic material as in claim 1, wherein the chemical sensitization process is a sulfur sensitization process, a selenium sensitization process, a noble metal sensitization process, or a combination thereof.

16. The silver halide photographic material as in claim 1, wherein the pH has been controlled to be 5.5 or less during at least one fifth of the period of the chemical sensitization time.

17. A process for the development of a a silver halide photographic material comprising a support having thereon at least one light-sensitive silver halide emulsion layer containing silver halide grains, wherein said silver halide grains have a silver chloride content of 30 mol% or more and contain (i) an iridium compound in an amount of $10^{-6}$ mol or less per mol of silver halide, (ii) at least one compound selected from the group consisting of iron, rhenium, ruthenium and osmium compounds in an amount of $10^{-3}$ mol or less per mol of silver halide, and (iii) (a) at least one compound selected from the group consisting of compounds represented by general formula (1-a), (1-b) and (1-c):

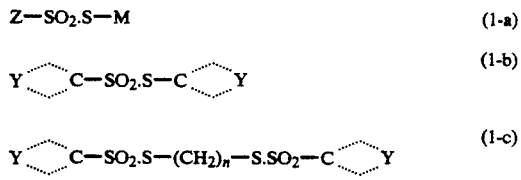

wherein Z represents a $C_{1-18}$ alkyl group, a $C_{6-18}$ aryl group or a heterocyclic group; Y represents an atomic group required for the formation of a $C_{6-18}$ aromatic ring or a heterocyclic group, said groups represented by Z or formed by Y may be substituted with at least one substituent; M represents a metallic atom or organic cation; and n represents an integer from 2 to 10, and/or (b) the silver halide grains have been chemically sensitized at a pH of 5.5 or less, wherein development processing is effected by an automatic developing machine in a total processing time of 20 to 60 seconds.

* * * * *